US005613865A

United States Patent [19]

Dullin et al.

[11] Patent Number: 5,613,865

[45] Date of Patent: Mar. 25, 1997

[54] AIRBAG SAFETY SYSTEM

[75] Inventors: Claus Dullin, Ilsfeld-Wüstenhausen; Anja Baumann, Heilbronn, both of Germany

[73] Assignee: Amphenol-Tuchel Electronics GmbH, Germany

[21] Appl. No.: 328,138

[22] Filed: Oct. 24, 1994

[30] Foreign Application Priority Data

Oct. 22, 1993 [DE] Germany ..... 43 36 140.4
Aug. 26, 1994 [DE] Germany ..... 44 30 358.9

[51] Int. Cl.[6] ..... H01R 29/00; H01R 13/627

[52] U.S. Cl. ..... 439/188; 439/353

[58] Field of Search ..... 439/352, 353, 439/357, 188, 358; 200/51.1

[56] References Cited

U.S. PATENT DOCUMENTS 5,314,345 5/1994 Cahaly et al. ..... 439/352
5,462,448 10/1995 Kida et al. ..... 439/357

*Primary Examiner*—P. Austin Bradley
*Assistant Examiner*—Yong Kim
*Attorney, Agent, or Firm*—Bacon & Thomas

[57] ABSTRACT

An ignition cable connector adapted to engage with an apparatus connector of an ignition generator to form a connector assembly, said ignition cable connector comprising an insulating body, a nose, and locking means spaced from said nose, said locking means being adapted to come into engagement with counter locking means provided at the apparatus connector.

19 Claims, 12 Drawing Sheets

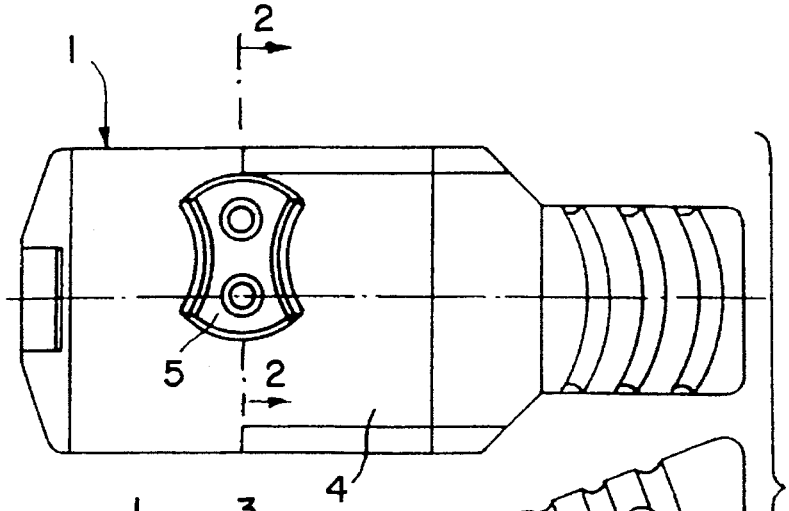
FIG. 1
Prior Art
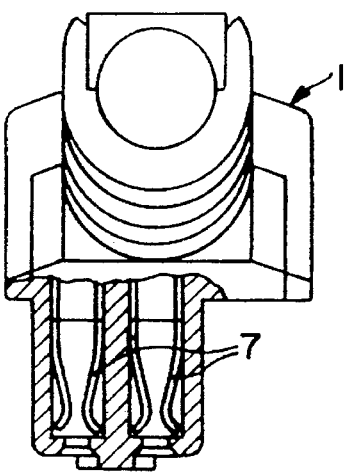
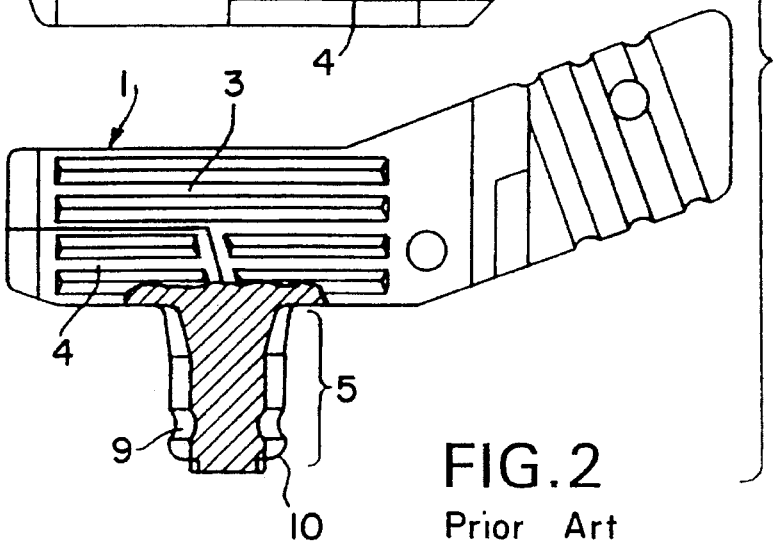
FIG. 2
Prior Art
FIG. 3
Prior Art 22
22

70
71
37
72
51
50
28
27
73
36
38
114

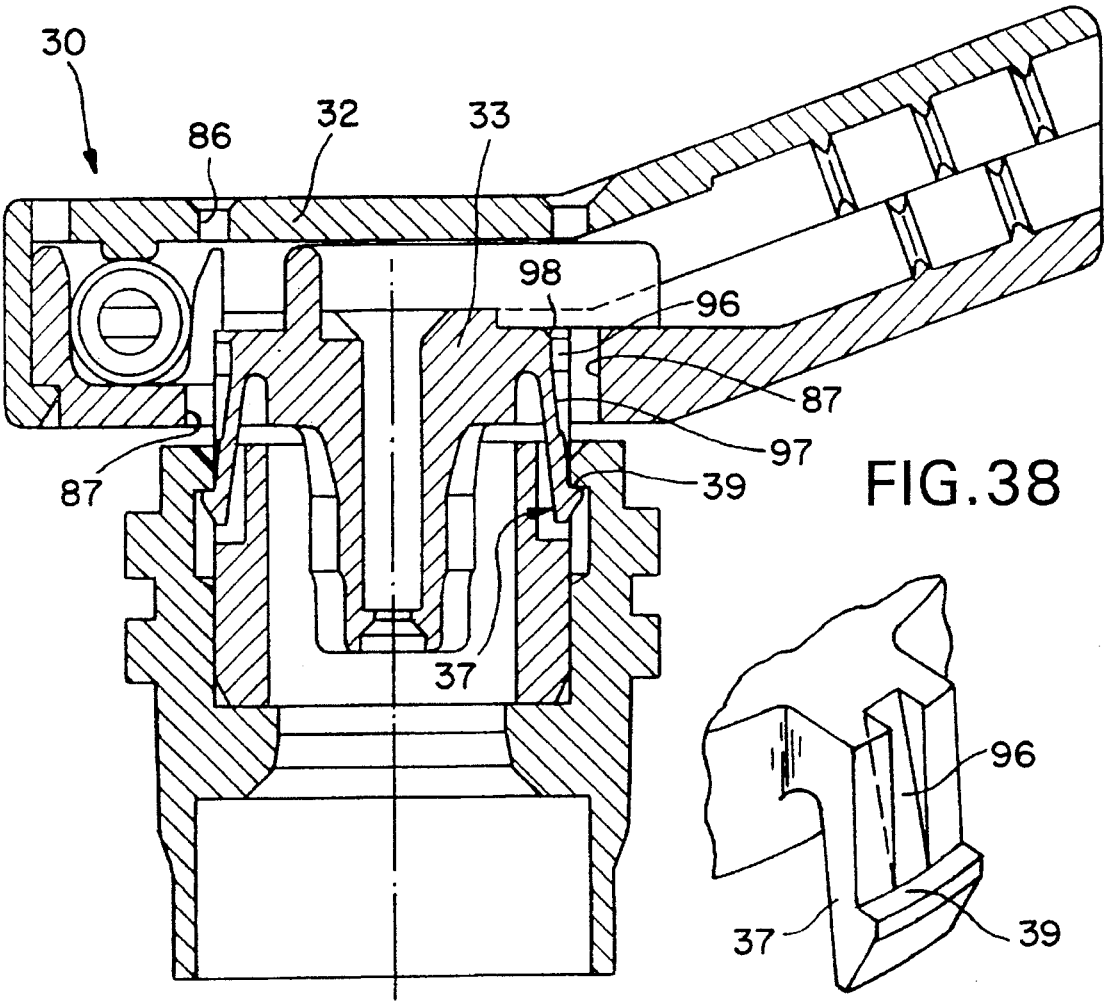
FIG.38
FIG.39
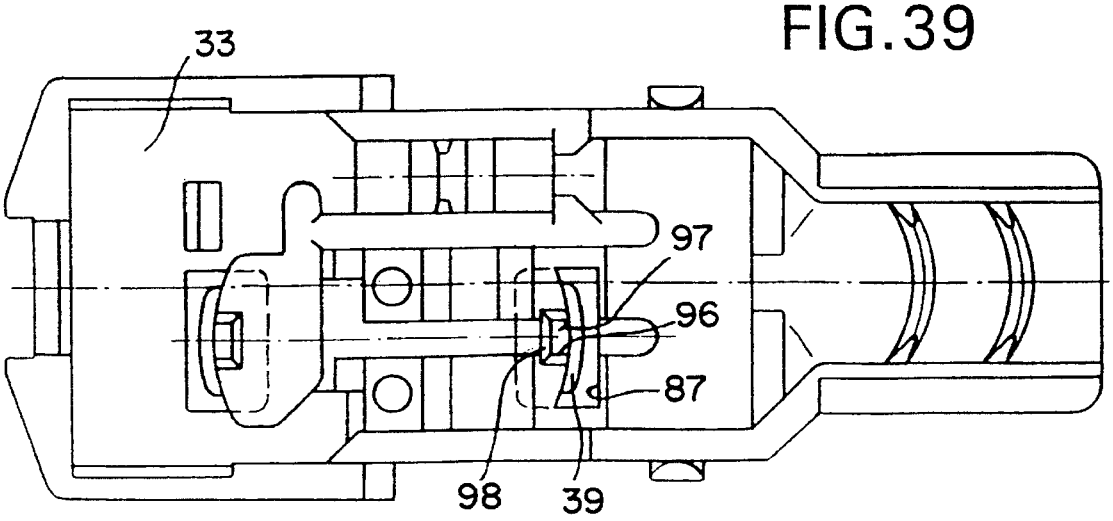
FIG.40

AIRBAG SAFETY SYSTEM

TECHNICAL FIELD

This invention relates generally to an airbag safety system and more particulary to a locking means for a connector of an airbag restraint system. The invention further relates specifically to the design of a connector assembly between an ignition cable and an igniter. This invention further relates to an ignition cable connector as well as to a so-called apparatus connector associated with the igniter.

BACKGROUND ART

German Patent 28 30 552 with the title "Safety means against short circuiting of an electric ignition means" should be noted.

It is already known to provide a releasable connector assembly between an ignition cable of an ignition control means and an airbag restraint or safety apparatus comprising an igniter. As is known, the igniter is used for igniting a gas generating charge (within said restraint apparatus) which, in turn, causes the deployment of the airbag (gas bag). Typically, the ignition of the igniter is caused by an electrical ignition signal which is supplied to the igniter from said ignition control means via said ignition cable. Thus, the ignition cable is connected to said ignition control means which generates the ignition signal in case the deployment of the airbag is required.

Commonly, the ignition cable leading to the restraint apparatus comprising the igniter is provided with an ignition cable connector preferably of the plug-type which can be coupled or plugged into an apparatus connector preferably of the jack or socket-type in a releasable manner. Said apparatus connector forms part of said restraint apparatus and of a unit thereof which might be referred to as an ignition generator. Generally speaking, the igniter and said apparatus connector are commonly arranged in a housing (ignitor support) of said ignition generator.

Below, referring to FIGS. 1 through 9 a known ignition cable connector as well as a known ignition generator will be described together with a respective apparatus connector.

It is already known to provide within the apparatus connector a so-called short circuit bridge means, so as to avoid an unintentional ignition of the ignition generator at a point in time where there is not yet provided the proper connection with the ignition cable connector. Said short circuit bridge means is adapted to provide a short circuit for the contact pins (there are generally two pins) of the apparatus connector of the ignition generator at a time when the ignition cable connector is not yet in engagement with the apparatus connector. When the ignition cable connector is brought into engagement with or inserted into the apparatus connector, then the short circuit bridge means is interrupted due to the fact that (two) contact springs or arms (contact spring arms) of the short circuit bridge are lifted from the respective contact pins. Said lifting of the contact arms is carried out by means of a projection or nose formed on said ignition cable connector. Said nose is provided with contact bushings or sleeves adapted for cooperation with the contact pins of the apparatus connector. Provided the nose is sufficiently inserted into the apparatus connector, then said contact arms will be lifted and, in addition, detent or locking means provided at said nose will come into locking engagement with counter detent or locking means which are provided in an insulating body of the apparatus connector.

It was recognized that for the above connector assembly an undesirable situation can occur if the nose is not completely inserted into the apparatus connector. Under these circumstances, see FIG. 8, the contact arms adapted to cause the short circuit, are lifted and the contact sleeves of the ignition cable connector are in contact with the contact pins of the apparatus connector, but no locking of the nose has yet occured so that, for instance, during operation of the vehicle using the restraint apparatus the vibrations of the vehicle might cause the nose and thus the entire ignition cable connector to separate from the apparatus connector (a counter connector) with the consequence that a critical situation occurs insofar as the airbag cannot be deployed which might lead to damages for the vehicle occupant.

It is an object of the present invention to provide for a connector assembly or system which is characterized by a well-defined locking effect providing for a sufficiently high holding force (which is for instance larger than 100N).

It is another object of the present invention to provide for an ignition cable connector which assures that the short circuit contact arms will only be opened if the ignition cable connector is safely locked at or in the apparatus connector.

It should be added that for the critical situation described above with a not properly locked ignition cable connector a diagnosis test would show that the restraint apparatus comprising the airbag is operative in as much as the short circuit contact arms are lifted, with the possible consequences referred to above.

So as to attain the above objects and to avoid the disadvantages of the prior art, the present invention provides for a defined locking between the two connectors of the connector assembly, i.e. specifically between the ignition cable connector and the apparatus connector.

In accordance with a preferred embodiment of the invention said defined locking effect is provided by integrated locking means at the ignition cable connector as well as by counter locking means at the connector of the ignition generator, i.e. the apparatus connector. Said locking means as well as said counter locking means being adapted to cooperate to provide a positive locking between said ignition cable connector and said apparatus connector. Said locking means are preferably in the form of locking hooks. Preferably said locking hooks are integrally formed integrated in the ignition cable connector and arranged such that they can only be released from said counter locking means by a respective tool.

In accordance with another embodiment of the invention the operation of the connector assembly of the invention can be further improved by providing push or inertia generating means which will make sure that the ignition cable connector will reach its proper operating position with the proper locking effect being provided in said operating position. Said desired push or inertia effect will be obtained when inserting the ignition cable connector into the apparatus connector by providing a pressure point-cam-locking means between the nose of the ignition cable connector and a receiving opening of an insulating body of the apparatus connector. In accordance with the invention and different from the prior art, this is achieved by placing the pressure point of the nose (which can also be called a plug nose) forwardly. As a consequence of this arrangement a safe opening of the short circuit contact arms is only achieved if the ignition cable connector is properly and safely inserted (i.e. plugged into the apparatus connector) and is in its detent or preferably locking condition.

Inasmuch as gas generators are manufactured in large numbers, significant changes of the ignition generator are not possible. This makes the solution of the above outlined problem difficult.

By arranging the locking means in accordance with the invention at the ignition cable connector not only a defined locking effect of the ignition cable connector at the apparatus connector is achieved, it is further possible to check the existence of a proper connection of the connector assembly simply by visual inspection and control.

Further advantages, objects and details of the invention can be gathered from the description of embodiments of the invention disclosed in the attached drawings.

FIGS. 1 through 9 disclose a connector system of the prior art comprising an ignition cable connector and an apparatus connector.

FIG. 1 is a bottom view of an ignition cable connector of the prior art;

FIG. 2 is a side elevational view of the connector of FIG. 1, partly in cross section;

FIG. 3 is a rear view of the ignition cable connector of FIG. 1, partly in cross section;

Figure 8:
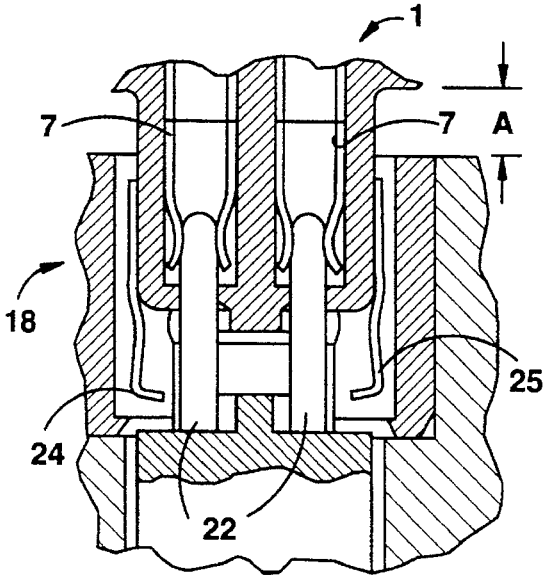
FIG.8 Prior Art
FIGS. 8 and 9 are sectional views (offset by 90°) of a part of the connector assembly represented by the ignition cable connector of FIG. 2 and the apparatus connector of FIG. 7, with said connectors being partially engaged.
Figure 9:
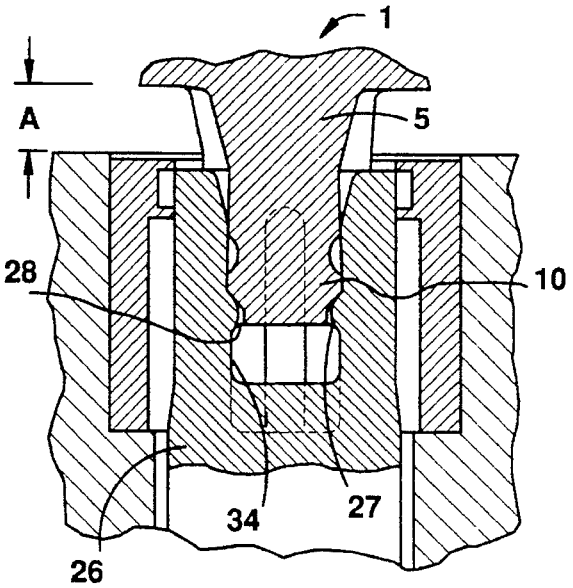
FIG.9 Prior Art
Figure 10:
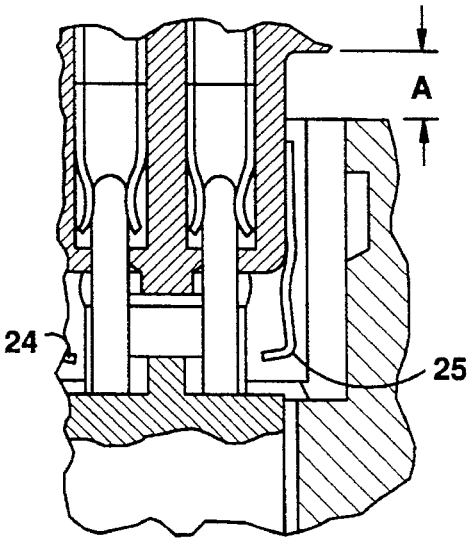
Figure 11:
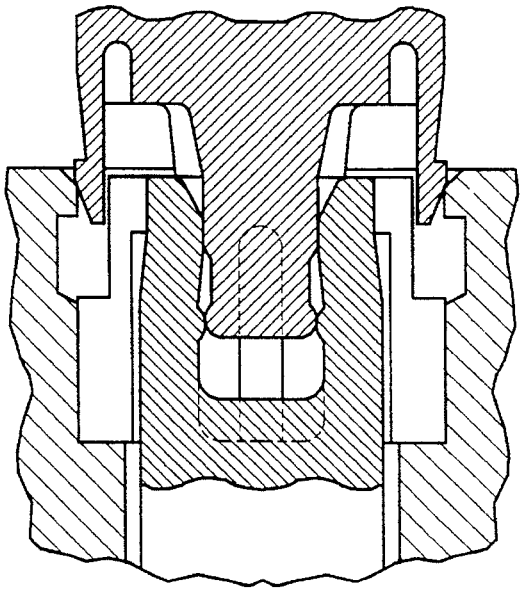
Figure 21:
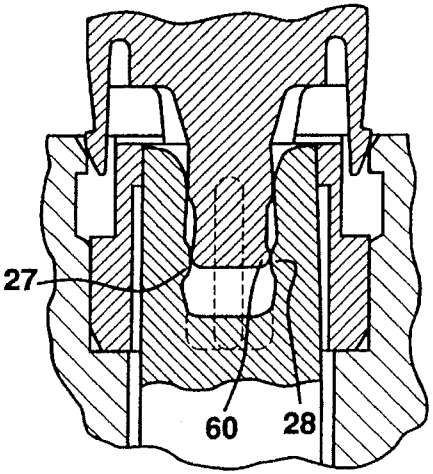
Figure 20:
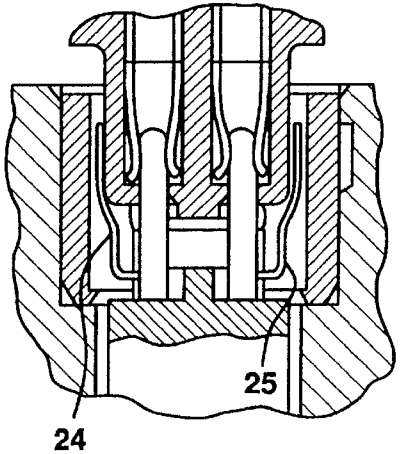

FIGS. 10 and 11 correspond to FIGS. 20 and 21 of the first embodiment of the invention; said FIGS. 10 and 11 being shown here adjacent to the prior art of FIGS. 8 and 9 to enhance the understanding of the invention.

FIGS. 12 through 23 refer to a first embodiment of the present invention disclosing the locking means of the invention as well as the push or inertia generating means.

Figure 12:
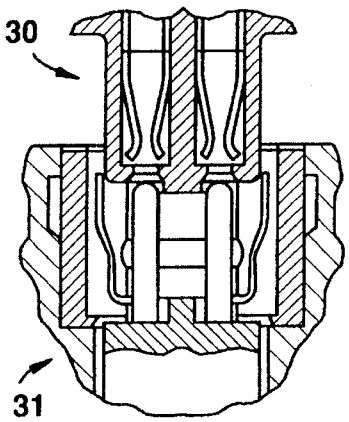
Figure 13:
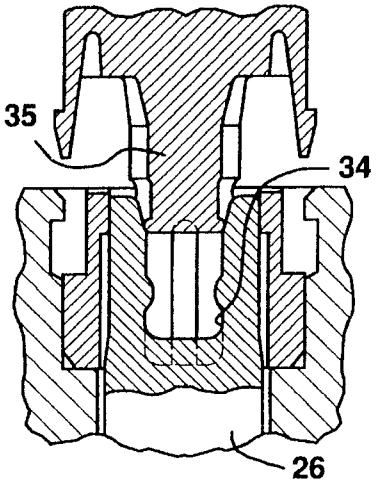
Figure 14:
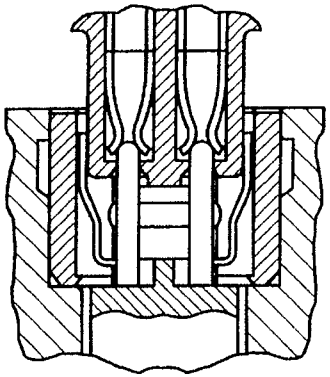
Figure 15:
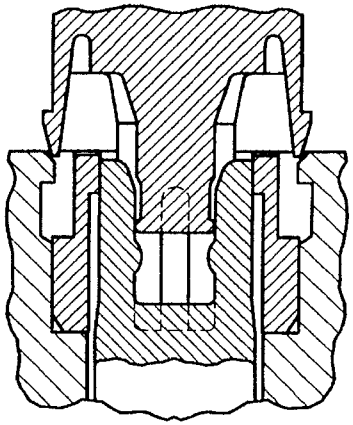
Figure 16:
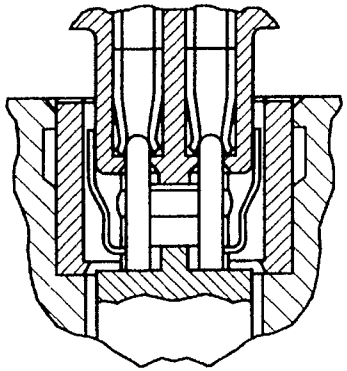
Figure 17:
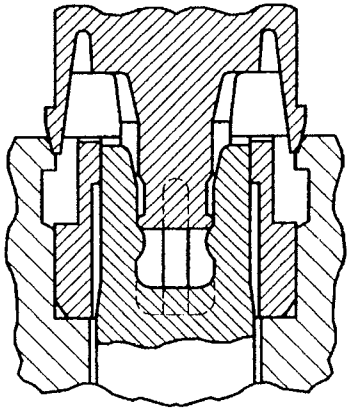
Figure 19:
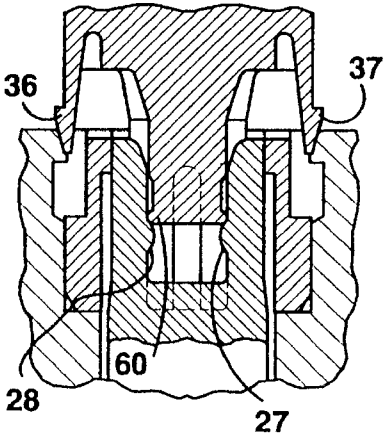
Figure 19A:
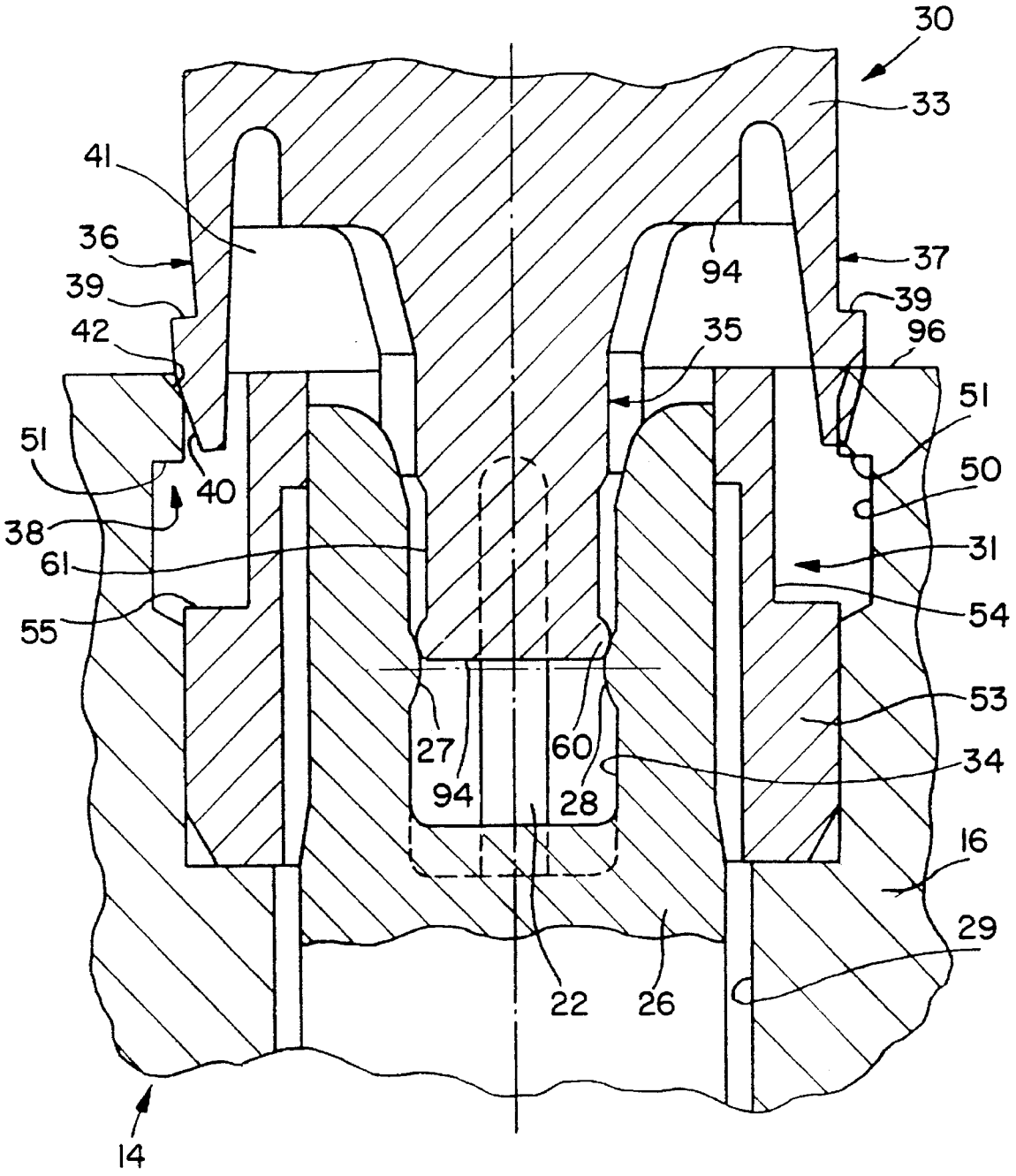
Figure 23:
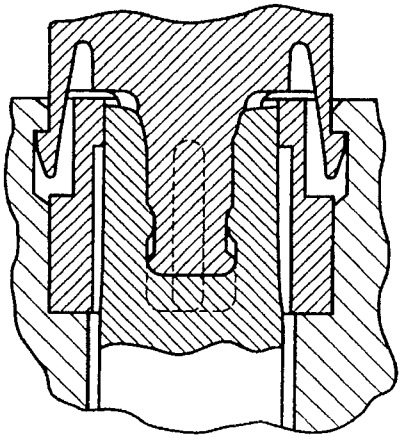
Figure 22:
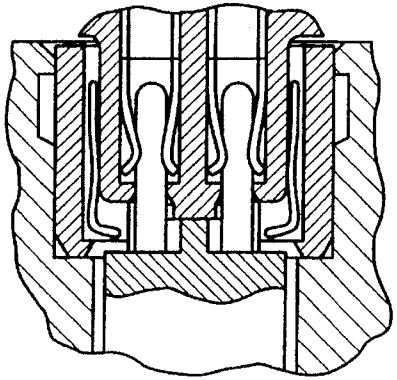
Figure 23A:
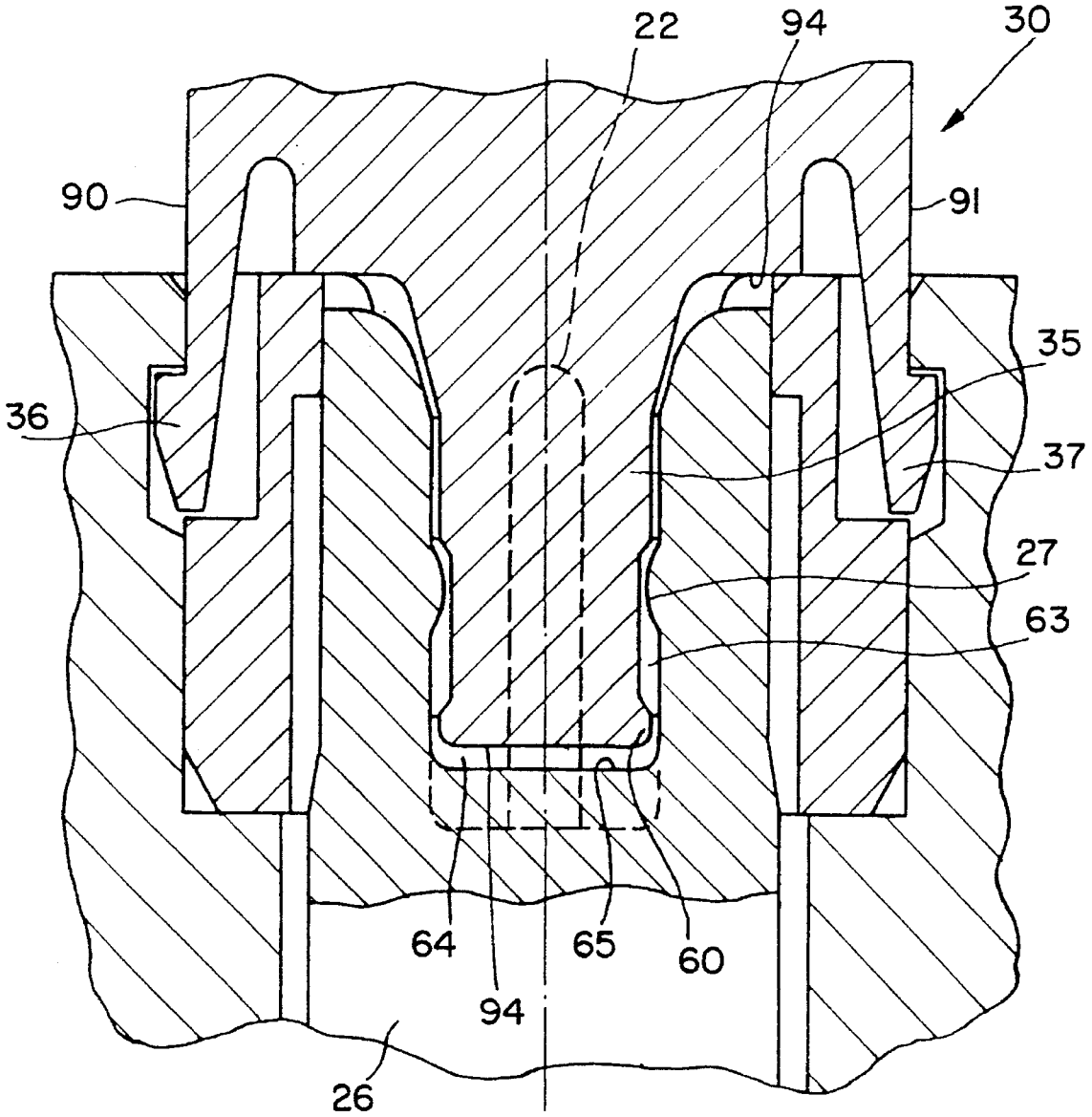

FIG. 12 discloses an initial phase of the insertion of an ignition cable connector into an apparatus connector, with said connectors being shown in cross section along line A—A in FIG. 1 (as far as the prior art is concerned);

FIG. 13 is the initial phase shown in FIG. 12 in a partial sectional view similar to FIG. 12, however, with the sectional line being rotated by 90° with respect to the sectional line A—A;

FIGS. 14 and 15 and likewise FIGS. 16 and 17 and FIGS. 18 and 19 as well as FIGS. 20 and 21 disclose intermediate stages of the insert operation of the ignition cable connector into the apparatus connector;

FIGS. 22 and 23 disclose the final stage of the insertion where the ignition cable connector and the apparatus connector are in engagement and properly locked to each other;

FIG.19*a* is an enlargement of FIG. 19;

FIG.23*a* is an enlargement of FIG. 23.

FIGS. 24 through 35 disclose a second embodiment of the invention, which is a simplified version of the first embodiment in so far, as the push or inertia effect generating means are not present, but only the locking means; Otherwise, the representations of FIGS. 24 through 35 are similar to the representations of FIGS. 12 through 23, and thus no additional explanations are necessary.

Figure 36:
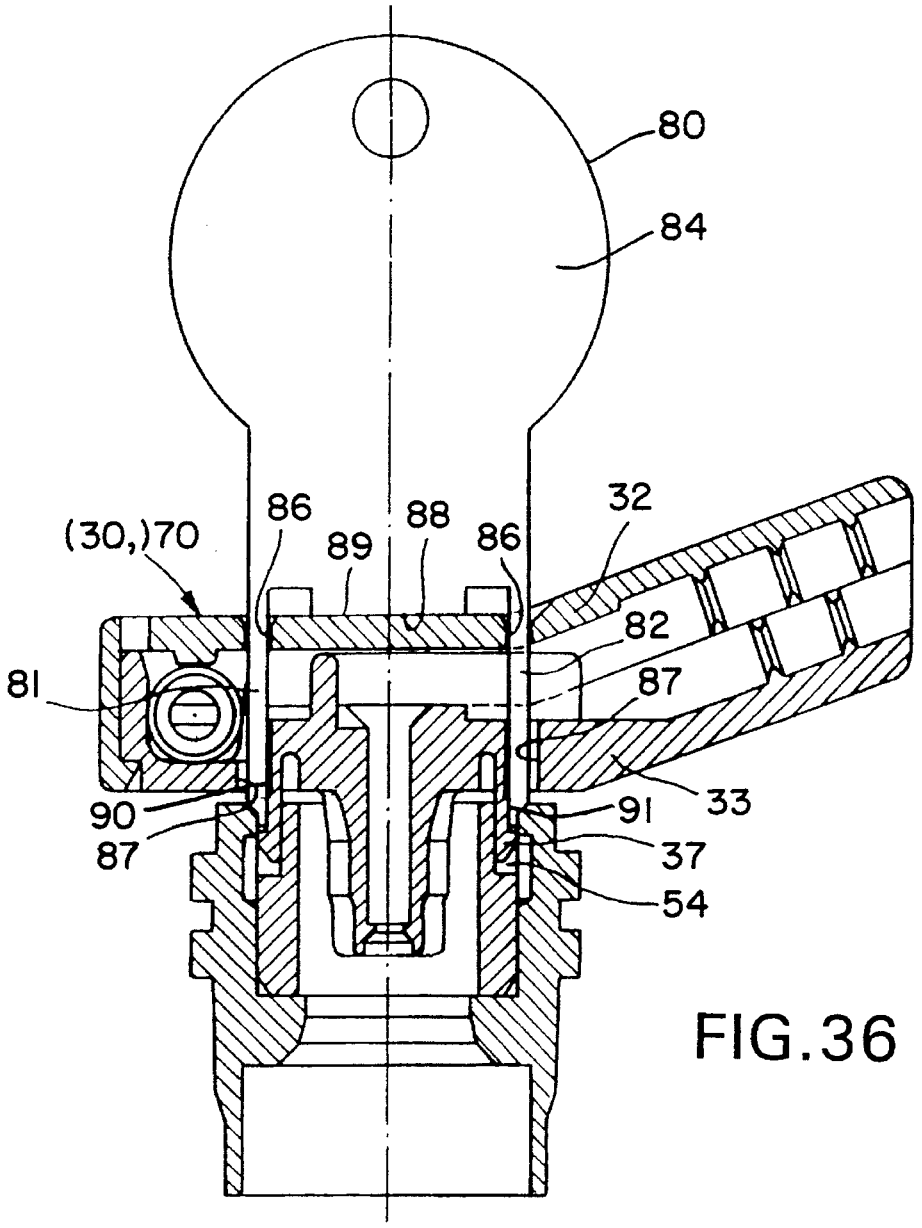
Figure 37:
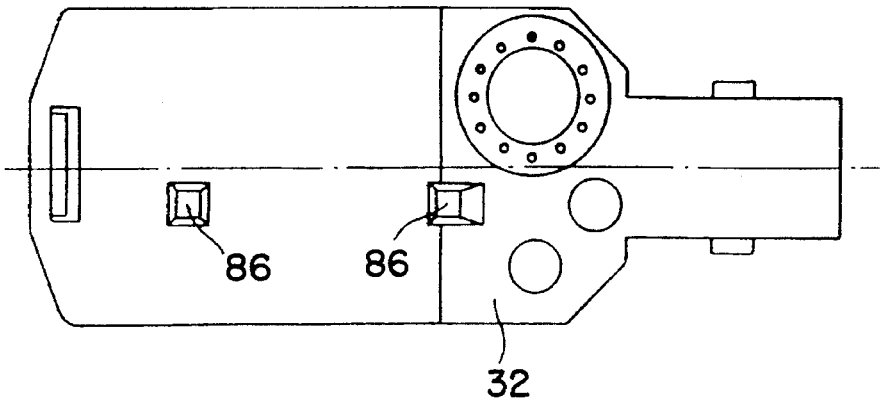
Figure 41:
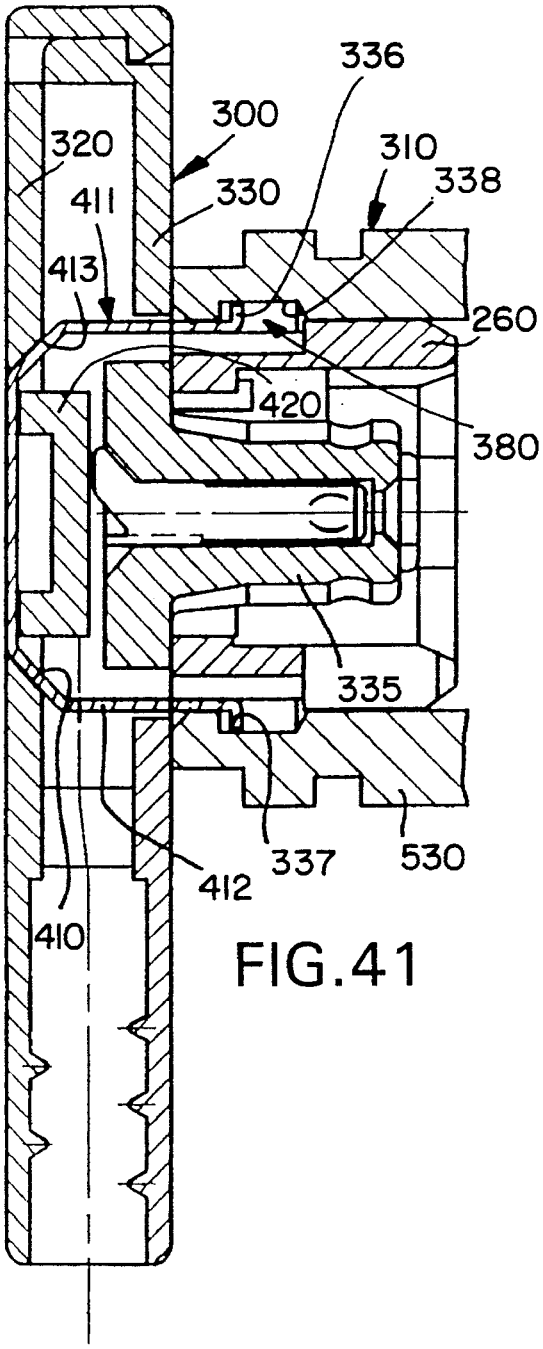
Figure 42:
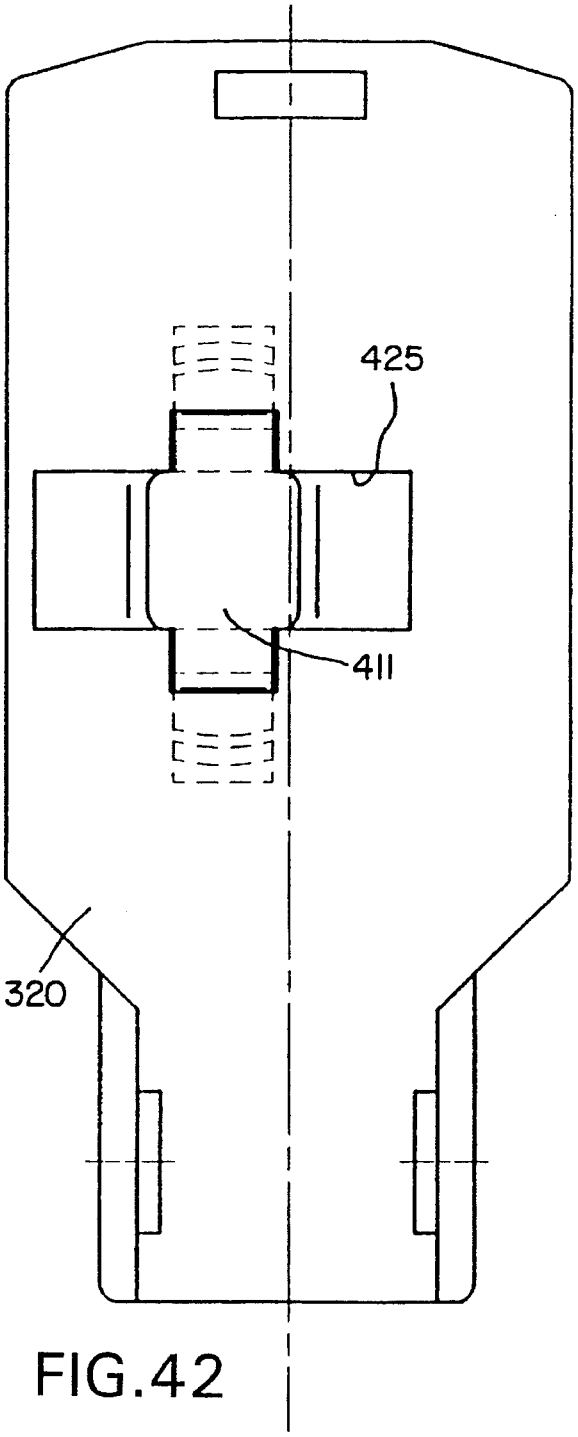

FIG. 36 is a sectional representation of the connector assembly of the second embodiment of the invention where the ignition cable connector is inserted into an apparatus connector, and where a de-locking tool is inserted to show the operation of de-locking the connector assembly;

FIG. 37 is a top plan view of the ignition cable connector of FIG. 36 with the tool not being shown;

FIG. 38 is a sectional view similar to FIG. 36, however, with the de-locking tool not being inserted;

FIG. 39 is a perspective view of a detail of the locking means in the form of a locking or detent hook shown in FIG. 38;

FIG. 40 is a top plan view of the ignition cable connector of the second embodiment with an insulating housing upper part being removed;

FIG. 41 is a sectional view of a third embodiment of the ignition cable connector; and FIG. 42 is a top plan view of the ignition cable connector of FIG. 41.

I. PRIOR ART

FIGS. 1 through 9 disclose the prior art which is improved by the present invention. The following description of the prior art is therefore also relevant for the respective elements of the invention.

Figure 4:
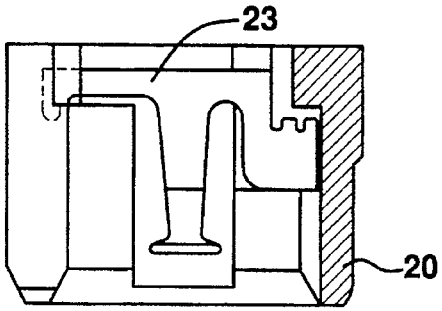
FIG.4 Prior Art
FIG. 4, 5 and 6 are different views of a prior art insulating ring having a short circuit bridge, said insulating ring being adapted to be inserted into the ignition generator shown in FIG. 7.
Figure 5:
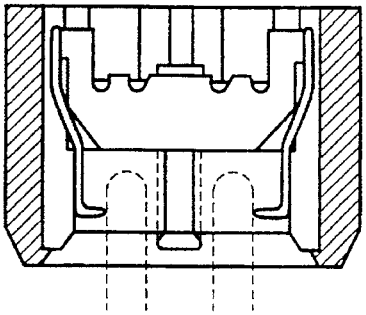
FIG.5 Prior Art
Figure 6:
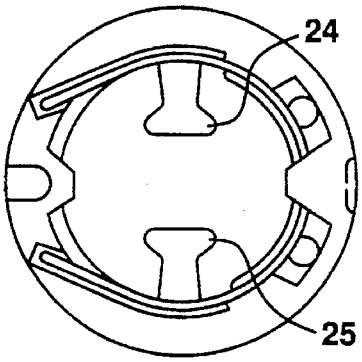
FIG.6 Prior Art
Figure 7:
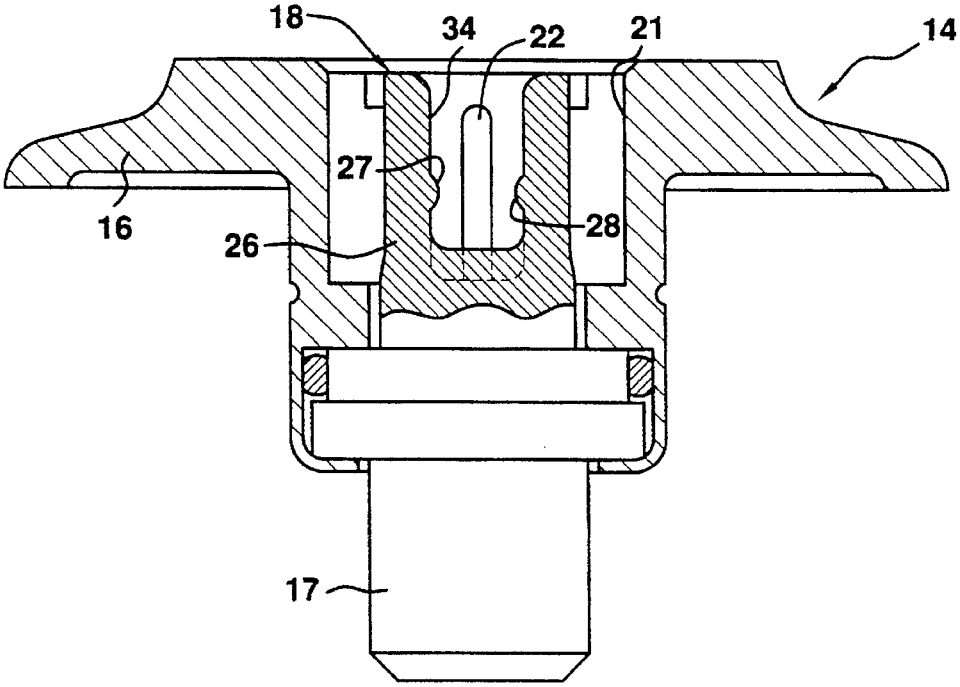
FIG.7 Prior Art
FIG. 7 is a side elevational view of an ignition generator, partly in cross section, comprising an apparatus connector adapted to receive said ignition cable connector.

FIGS. 1 through 3 disclose an ignition cable connector 1 which is adapted to be coupled, i.e. inserted, into an apparatus connector 18 shown in FIG. 7. Generally speaking, the ignition cable connector (connector) 1 is adapted to form together with the apparatus connector (counter connector) 18 a connector assembly. The cable connector 1 is made of insulating material and comprises an insulating body which consists of an insulating body upper part 3 and an insulating body lower part 4. As a single piece or integrally formed together with the insulating body lower part 4 is a plug portion or a nose (projection) 5. In said nose 5 there are located contact elements, i.e., as is shown in FIG. 3, typically two contact sleeves 7 adjacent to each other. At the nose 5 there are formed oppositely located detent grooves 9 as well as detent bulges or projections 10.

As mentioned, the ignition cable connector 1 can be inserted into the apparatus connector 10 of an ignition generator 14 (which is adapted to be combined with an occupant restraint apparatus). Prior to such an insertion, however, an insulating ring 20 is placed in the apparatus connector 18 which is preferably of the jack- or socket type. Said insulating ring 20 is disclosed in detail in FIGS. 4 through 6. The insulating ring 20 supports in a manner known per se a short circuit bridge means or contact ring 23 which comprises two short circuit contact arms 24, 25 which are oppositely located to each other.

As is shown in FIG. 7, the insulating ring 20 is adapted to be inserted into a recess 21 of an insulating body 26. Said recess 21 is formed between the housing or support 16 of the ignition generator 14 and the insulating body 26. Said housing 16 is adapted to support an igniter 17.

The insulating body 26 is suitably mounted to the igniter 17 and forms together with the insulating ring 20 the apparatus connector 18.

The apparatus connector 18 further comprises two contact pins 22 (connected to the igniter 17) which are located in the insulating body 26. As long as the nose 5 is not inserted into the apparatus connector 18, the short circuit contact arms 24, 25 are in engagement with said contact pins 22.

First Embodiment of the Invention

FIGS. 12–23

FIGS. 8 and 9 show in two different sectional prior art views which are offset by 90° with respect to each other that the insertion of the nose 5 into receiving chamber 34 formed by the insulating body 26 a lifting of the short circuit contact arms 24, 25 and also a contact engagement between the sleeves 7 and the contact pins 22 can occur without the bulges or projections 10 of the nose 5 being already behind cams or projections 27, 28 which are at the inner surface of the receiving chamber 34 of the insulating body 26. This means that the ignition cable connector 1 in fact might not be completely plugged into or inserted and is thus also not completely in a detent engagement with the apparatus connector 18. A test of the airbag system under these circumstances would indicate that the system is operative. However, in operation, due to vibrations of a vehicle it might occur that the ignition cable connector 1 separates from the apparatus connector 18 with the consequence that the restraint apparatus airbag safety system would not be operative any more.

As can be seen from the face to face arrangement of FIGS. 8 and 9 of the prior art with FIGS. 10 and 11 of the invention, the design of the invention shown in FIGS. 10 and 11 does not provide for a lifting of the short circuit contact arms 24, 25 prior to passing through the distance of insertion A. As a consequence, an electrical test of the connector system of the invention shown in FIGS. 10 and 11 will immediately show that the ignition cable connector is not yet properly inserted.

Turning now in more detail to FIGS. 12 to 23 which disclose the first embodiment of the invention, the individual phases for establishing the connector assembly of the invention comprising the ignition cable connector 30 and the apparatus connector 31 are shown. For a description of the structural features attention see specifically FIGS. 19 and 23 and the enlarged versions of said figures shown FIGS. 19*a* and 23*a*.

Specifically, FIG. 19*a* discloses the ignition cable connector 30 which forms in accordance with the invention a connector assembly together with the apparatus connector 31. Preferably, the ignition cable connector 30 is of the so-called plug type, while the apparatus connector 31 is of the so-called jack or socket type.

The ignition cable connector 30 comprises—see also FIG. 36 and 38 of a second embodiment, which similar insofar to the first embodiment—an insulating body upper part 32 and an insulating body lower part 33. Both said parts are fixedly mounted together in an appropriate manner. In FIG. 19*a* a part of the insulating body lower part 33 is shown as comprising—similarly to the prior art—a nose or projection 35 which extends downwardly in FIG. 19*a*. At the insulating body lower part 33 locking means 36, 37 are provided which are spaced with respect to said nose 35. Preferably, said locking means are provided in the form of hooks 36, 37. Said locking means 36, 37 are adapted to cooperate with respective counter locking means 38 of the apparatus connector 31. Preferably, two hooks 36, 37 are diametrically located with respect to each other. Each of said hooks 36, 37 comprises a locking or holding surface 39 as well as a guide surface 40 which is inwardly inclined. Between the nose 35 and said hooks 36, 37 a recess 41 is provided.

The inclined surfaces 40 are adapted to cooperate with inclined guide surfaces 42, which are provided for example at the apparatus connector 31. In the first embodiment as shown in FIG. 19*a* said guide surfaces 42 are, however, provided at the housing 16 of the ignition generator 14. Regarding the ignition generator 14 see the prior art shown in FIG. 7.

The ignition generator 14 is provided with said counter locking means 38 which are adapted to cooperate and come into locking engagement with the locking means, specifically the hooks 36, 37. Said counter locking means 38 comprise a locking groove 50 which is, for example, of annular shape and is provided in the housing 16. Said locking groove 50 forms at its upper end a locking or holding surface 51.

So as to avoid too many changes of the design of the ignition cable connector 1, said hooks 36, 37 are (see the position shown in FIG. 19*a*) of resilient design. Further, preferably, a recess 54 is provided in the insulating ring 20 (which corresponds to insulating ring 53), so as to accommodate of the hooks 36, 37 in the ignition generator 14.

Further, preferably and in addition two opposite projections or cams 60 are provided approximately at the end of the nose 35, i.e. said additional projections 60 are positioned forwardly with respect to the projections 10 of the prior art of FIG. 2. The cams or projections 27, 20 in the insulating body 26 maintain their position which is known from the prior art.

FIG. 23*a* discloses that if the ignition cable connector 30 is completely inserted and locked, the nose 35 comprises a certain amount of spacing or play 36 due to the distance between the pressure point cam 60 and the cam or projection 27, so that the locking of the ignition cable connector 30 is defined by the locking means 36, 37 and the counter locking means 38. There is also a spacing or play 64 between the lower end of the nose 5 and the oppositely located end wall 65 of the insulating body 26.

Figure 18:
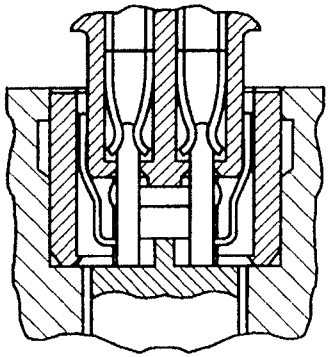

FIGS. 12 through 23 illustrate the operation, i.e. the establishment of the connector assembly of the first embodiment. In FIGS. 12 and 13, the nose 35 is only partially inserted into the respective recess 34 of the insulating body 26. FIGS. 14 and 15 show the locking hooks 36, 37 adjacent to and in FIGS. 16 and 17 in sliding engagement with the guide surfaces 42. In FIGS. 18 and 19 the locking hooks 36, 37 are resiliently bent inwardly and the nose 35 has reached with its two cam projections 60 the pressure point provided by cams 27, 28. The transition from the illustration of FIGS. 20 and 21 to the representation of FIGS. 22 and 23 show the generation of a push or inertia effect due to the cooperation of the projections or cams 60 with cams 27, 28. Said push effect assures that the locking effect between the hooks 36, 37 and the locking surface or surfaces 51 is securely established. Said means for generating the push effect are defined by said pressure point cams (projections) 60, 27, 28 arranged in the specifically disclosed position, thus cause a secure mating and locking condition for the ignition cable connector 30 and the apparatus connector 31.

As was already mentioned, the cam or projection means 60 at the lower end of the nose 35 comprises preferably two oppositely arranged pressure point cam projections which provide for a go/no go-effect with a pressure point. This effect is provided in cooperation with the two cams or projections 27, 28 which are provided for by the apparatus connector. As explained above, when the pressure point is overcome, a pushing effect is created which opens the short circuit bridge and locks the two connectors, i.e. the ignition cable connector 30 and the apparatus connector 31, preferably by means of said locking hooks 36, 37. The short circuit contact arms 24, 25 will only be opened if the ignition cable connector 30 is securely locked at the apparatus connector 31. Thus, a condition where the ignition cable connector 30 and the apparatus connector 31 are not locked, can be readily recognized by the test electronic used to diagnose the restraint apparatus comprising the airbag system. The locking means of the invention provide for a holding force which is preferably larger than 100N, said force being defined by the strength of the material of which the locking hooks 36, 37 are made. Thus, in accordance with the invention, the holding force does not depend on the tolerances of the detent bulge and the detent groove, as is true for the prior art.

The depthwise abutment of the connector assembly of the invention is defined by the abutment of the ignition cable connector bottom 94 (see FIGS. 19*a* and 23*a*) on the surface 65 of the housing 16, regardless of the position which is assumed by the igniter in said housing 16. As mentioned above, a certain amount of play or spacing is provided between the pressure point locking cam projections.

Figures 24, 25, 26, 27, 28, 29, 30, 31:
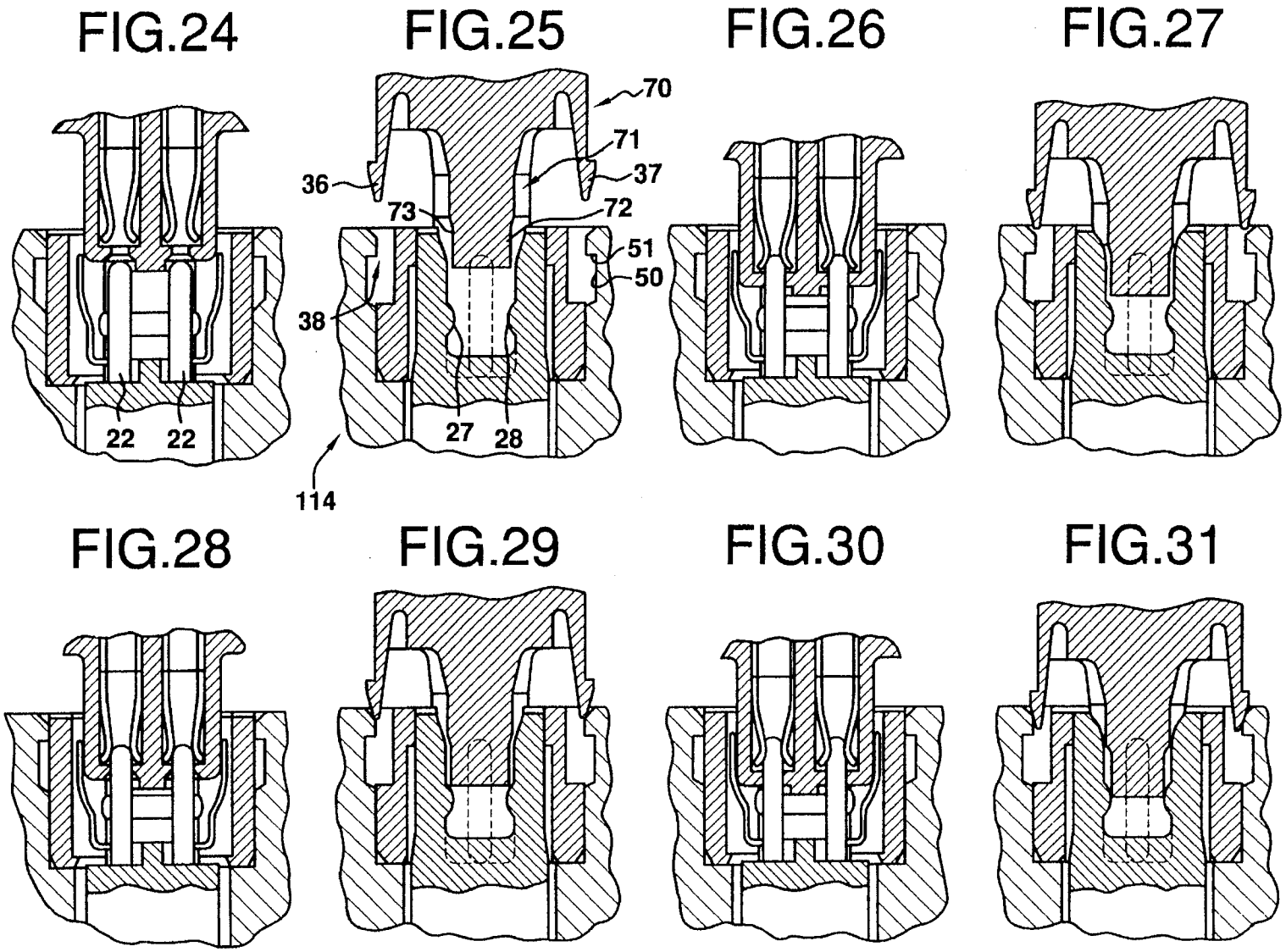

The operation of the first embodiment of the invention can be even further improved by placing the short circuit bridge means or contact ring 23 at a lower level e.g. in FIG. 24. It can be specifically provided that the bent of the short circuit contact arms 24, 25 is moved downwardly, so that the lifting of the short circuit spring arms from the appropriate contact pins 22 will securely occur only after the pressure point cam projections 28 have moved beyond the pressure point, i.e. the locked condition of the ignition cable connector and the apparatus connector has been securely reached.

SECOND EMBODIMENT

Figures 32, 33, 34, 35:
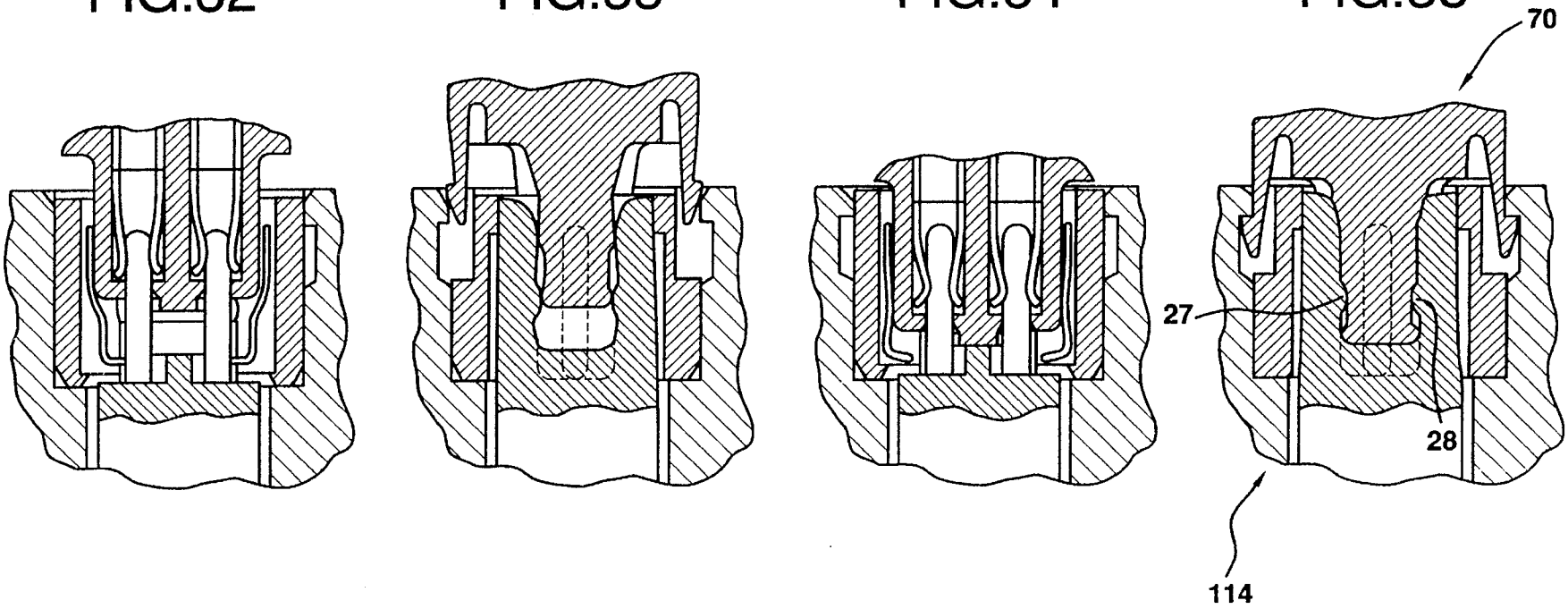

FIGS. 24 through 35 disclose a second embodiment of the invention which differs from the first embodiment specifically in so far that no push effect generating means are provided, so as to save on cost. In the second embodiment the ignition cable connector 70 comprises a nose 71 with a nose end 72. The pressure point cam projections 60 of the first embodiment are not present in this case. The nose 71, however, forms an abutment surface 73 which is adapted to come into abutment with the two cam projections 27, 28 of the apparatus connector 114 as is shown in FIG. 35, provided that a proper plug-in or mating condition exists. FIGS. 24 through 35 disclose the insertion of the ignition cable connector 70 for different depths of insertion similar to what is shown in FIGS. 12 to 23 of the first embodiment.

It should be noted that for all embodiments of the invention the locking means 36, 37 are in a plane which is offset by 90° with respect to a plane containing the contact sleeves. Similarly, the counter locking means 50, 51 are provided in the apparatus connector 30, 70 in the same plane as the locking means 36, 37, i.e. also effect by 90° with respect to the plane which contains the contact pins 22.

DE-LOCKING OPERATION

As is shown in FIGS. 36 and 37 the connector systems of the first and second embodiments are designed such that the de-locking operation cannot be carried out accidentally, but only by means of a de-locking tool 60. The de-locking tool 80 comprises a grip portion 84 and, oppositely thereto, two pins 81 and 82 between which an abutment surface 88 extends. The abutment surface 88 is adapted to come into abutment or engagement with an upper surface 89 of the ignition cable connector 30 and, in this position, a de-locking of the locking hooks 36, 37 occurs in the manner as is shown.

Openings 86, 87 in the ignition cable connector 30 allow the penetration of the pins 81, 82 such that the inner surfaces of the pins 81, 82 come into engagement with the surfaces 90, 91 of the arms of the hooks 36, 37 which are outwardly inclined in the locked condition, and such that said pins 81, 82 move the hooks 36, 37 inwardly to an extent that the surfaces 39, 51 come out of engagement and the ignition cable connector 30 can be pulled out of the apparatus connector 14, 114.

In FIGS. 38 through 40 the design of the ignition cable connector 30 or, more precisely of connector 70 (because FIGS. 38 to 40 do not show "push generating means") is disclosed in more detail in connection with the de-locking operation. It can be recognized specifically in FIG. 39 that the two hooks 36, 37 each comprises, preferably approximately in the middle, a slot 96 which forms a bottom or an inclined surface 97 which is designed such —see FIG. 38—that the depth of the slot decreases towards the holding or locking surface 39. The inclined surface 97 preferably has, as is shown in FIGS. 38, in its middle a change of direction, i.e. the depth of the slot decreases at said location almost steplike. The openings 87 are preferably provided with inclined surfaces 98, so as to allow for a secure insertion of the de-locking tool 80. As can be seen specifically from FIGS. 39 and 40 the locking or holding surface 39 of the hook is preferably arcuate and preferably also has a significant width (as is shown), so as to provide for a secure locking effect.

The locking means provided between the housing of the ignition cable connector 30, 70, specifically its insulating body lower part 33 and the ignition generator 14 can be of different design as described. For instance, the hooks can be provided at the ignition generator 14 and the respective counter locking means can be provided at the ignition cable connector. However, this would have the disadvantage that significant changes are required at the ignition generator 14. It is also conceivable that the hooks provided at the ignition cable connector carry out an inward movement during the locking operation. It is further conceivable that the locking means, specifically the hooks 36, 37, come into locking engagement solely with the housing 16, with the insulating ring 20 remaining unmodified.

Instead of providing the preferred defined positive locking effect between the ignition cable connector and the apparatus connector, it is also conceivable to have a detent connection between the hooks 36, 37 and respective counter detent means. In the latter case the locking surfaces 39, 51 would have to be respectively amended. For such a design it would be possible to remove the ignition cable connector from the apparatus connector simply by applying a pulling force without requiring a tool.

The invention further provides that neither the igniter nor the insulating ring 20 project beyond the upper edge of the housing 16 of the igniter.

The features of the present invention will not change the present course of manufacture of the ignition generators and the associated gas generators. It is only necessary to provide for the small change in the form of a recess in the housing 16 of the ignition generator or igniter and possibly an appropriate adaptation of the bottom of the igniter has to be provided.

The features of the invention provide for the so-called backward compatability, i.e. the prior art ignition cable connectors will fit into the ignition generators provided by the invention. Due to the fact that the customary contacting principle is maintained, the entire system will not become more expensive.

THIRD EMBODIMENT OF THE INVENTION

FIGS. 41 and 42 disclose a third embodiment of the invention. An ignition cable connector 300 and an apparatus connector 310 are adapted to form a connector assembly.

The ignition cable connector 300 comprises an insulating body upper part 320 and an insulating body lower part 330. From the insulating body lower part 330 a nose 335 projects downwardly or rightwardly in FIG. 41.

Locking means 411 are provided at the insulating body upper part 320. Said locking means 411 preferably comprise two hooks 336 and 337. The locking means 411, specifically the hooks 336 and 337 are adapted to cooperate with respective counter locking means 380 of the apparatus connector 310.

In the embodiment as shown the counter locking means 380 are preferably formed by an annular radially extending recess. Said recess being preferably formed in a sleeve (for instance a metal sleeve) 530. Within said sleeve 530 an insulating body 260 is located.

The locking means 411 which comprise the hooks 336 and 337 are preferably designed in the form of a metallic clip 411. Said metallic clip 411 can be released from its locking position at the apparatus connector by means of a tool (for instance a screw driver) by lifting said metal clip 411. When the metal clip 411 is lifted, arms 412 of the metal clip 411 are pressed towards each other due to an inclined surface 410 in the ignition connector body upper part 32. The inward movement of the arms of the metal clip 411 causes the release of the arms and hooks from the counter locking means 380.

The metal clip 411 comprises two arms 412 which comprise the hooks 336 and 337. Said arms 412 comprise an inclined portion 413 which are adapted to cooperate with the above-mentioned inclined surface 410. More specifically, the metal clip 411 comprises two oppositely located inclined portions 413. The connecting portion of the clip 411 which extends between said two arms 412 extends substantially in alignment with the upper side of the insulating body upper part 32 and is located with its inner side at a portion 420 of the lower portion 330. Said portion 420 being U-shaped in cross section. The portion 420 comprises a recess 425 in which the screw driver may be inserted, so as to move clip 411 in FIG. 41 leftwardly. As a consequence, the inclined portions 413 slide leftwardly along the inclined surfaces 410, so as to bring the hooks 336 and 337 out of engagement with the respective counter locking means 380.

We claim:

1. An ignition cable connector (30, 70) adapted to engage with an apparatus connector (31) of an ignition generator (14) to form a connector assembly, said ignition cable connector comprising:

an insulating body (3, 4; 32, 33; 320, 330);

a nose (35; 335) extending from said insulating body (33); and locking means (36, 37) in the form of hooks extending from said insulating body (33) and spaced from said nose (35), said hooks being adapted to come into engagement with counter locking means (38) provided at the apparatus connector (31).

wherein said hooks each includes a guide slot (96) adapted to receive a tool which, when inserted into said guide slot, causes a corresponding one of said hooks to move inwardly towards said nose and thereby disengage said hooks from said counter locking means, and wherein said hooks are located in a plane which is offset by 90° with respect to a plane defined by short circuit contact arms (24, 25) positioned in said ignition cable connector.

2. An ignition cable connector (30, 70) adapted to engage with an apparatus connector (31) of an ignition generator (14) to form a connector assembly, said ignition cable connector comprising:

an insulating body (3, 4; 32, 33; 320, 330);

a nose (35; 335); and locking means (36, 37) spaced from said nose (35), wherein said nose comprises at its free or lower end pressure point cam means (60) adapted to cooperate with cam means (27, 28) or an insulating body (26) of the apparatus connector such that push effect generating means are formed, said push effect generating means making sure that short circuit contact arms (24, 25) provided in the apparatus connector will be disengaged from contacting contact pins provided in the apparatus connector (31) only if the locking of the ignition cable connector (30, 70) at the apparatus connector (31) is secured by means of said locking means (36, 37).

3. An ignition cable connector according to claim 2, wherein said cam means are formed by two oppositely located cam projections (60).

4. An ignition cable connector according to claim 2, wherein the design is such that between pressure point cam (60) at the nose (35) and the pressure point cams (27) at the inner surface of the insulating body (26) a play or a distance (63) is provided in the locked condition of the ignition cable connector.

5. An ignition cable connector (30, 70) adapted to engage with an apparatus connector (31) of an ignition generator (14) to form a connector assembly, said ignition cable connector comprising:

an insulating body (3, 4; 32, 33; 320, 330);

a nose (35, 335); and locking means (36, 37) spaced from said nose (35), wherein openings (96) are provided in the ignition cable connector (30, 70) for the insertion of a de-locking tool (80) such that the inserted de-locking tool (80) will resiliently release the locking means (36, 37) and the ignition cable connector can be pulled out of the apparatus connector (31).

6. An ignition cable connector (30, 70) adapted to engage with an apparatus connector (31) of an ignition generator (14) to form a connector assembly, said ignition cable connector comprising:

an insulating body (3, 4; 32, 33; 320, 330);

a nose (35; 335); and locking means (36, 37) spaced from said nose (35), wherein said locking means (36, 37) are located in a plane which is offset by 90° with respect to a plane which is defined by contact sleeves of said ignition cable connector.

7. An ignition cable connector (30, 70) adapted to engage with an apparatus connector (31) of an ignition generator (14) to form a connector assembly, said ignition cable connector comprising:

an insulating body (3, 4; 32, 33; 320, 330);

a nose (35; 335); and locking means (36, 37) spaced from said nose (35), wherein guide slots (96) are provided in said locking means (36, 37), said guide slots being adapted to receive a tool which, when inserted into said opening, causes said locking means to disengage from said counter locking means.

8. An ignition cable connector according to claim 7, wherein said slots (96) have a depth which decreases towards holding surfaces (39) of said locking means.

9. An ignition cable connector according to claim 7, wherein said locking means form a holding surface which is generally arcuate and corresponds to a locking surface (39) provided by the apparatus connector.

10. An ignition cable connector of claim 7, wherein said locking means are provided in the form of hooks (36, 37).

11. An ignition cable connector of claim 7, wherein the locking means are provided in the form of resiliently pivotable hooks (36, 37).

12. An ignition cable connector according to claim 10, wherein said hooks are integrally formed, with said insulating body.

13. An ignition cable connector according to claim 12, wherein said insulating body comprises an insulating body lower part to which said hooks (36, 37) are connected by means of arms which extend substantially parallel to said nose (35) thus forming a recess (41), in said insulating body.

14. An ignition cable connector according to claim 7, wherein the insulating body forms an ignition cable connector bottom (94) adapted to abut an upper surface (96) of the apparatus connector (31) when the connector assembly is established.

15. An apparatus connector, in particular for an ignition generator (14), said apparatus connector (31) comprising:

an insulating body (26) supporting contact pins as well as an insulating ring together with short circuit contact means, a housing (16) surrounding said apparatus connector (32), and counter locking means (38) in the apparatus connector adapted to cooperate with an ignition cable connector, wherein a receiving chamber (34) is provided in the said insulating body (26), and wherein further cam means are provided in said receiving chamber (34), cam means which are preferably designed in the form of two oppositely located cams (27, 28), wherein said short circuit means comprise two contact arms each having a bent portion, each of said bent portions being located in the direction of the coupling movement such that the lifting of the short circuit contact arms away from the respective contact pins (22) of an ignition cable connector is carried out with security only after the cams (27, 28) providing a pressure point have been passed, so that the locked condition of ignition cable connector and apparatus connector is safely achieved.

16. An apparatus connector, in particular for an ignition generator (14), said apparatus connector (31) comprising:

an insulating body (26) supporting contact pins as well as an insulating ring together with short circuit contact means, a housing (16) surrounding said apparatus connector (32), and counter locking means (38) in the apparatus connector adapted to cooperated with an ignition cable connector, wherein the counter locking means (50, 51) are located in a plane which is offset by 90° with respect to a plane which contains contact pins (22) of the apparatus connector.

17. An ignition cable connector (30, 70) adapted to engage with an apparatus connector (31) of an ignition generator (14) to form a connector assembly, said ignition cable connector comprising:

an insulating body (3, 4; 32, 33; 320, 330); a nose (35; 335); and locking means (36, 37) spaced from said nose (35), said locking means being adapted to come into engagement with counter locking means (38) provided at the apparatus connector (31), wherein said locking means are provided in form of a metal clip (411), said metal clip (411) being anchored in said ignition cable connector (30) and comprises locking means (411) which are adapted to come into engagement with counter locking means (38)) at an apparatus connector (310).

18. An ignition cable connector according to claim 17, wherein the locking means in the form of a metal clip (411) can be de-actuated by means of a tool, for instance a screw driver, such that the metal clip is deformed such that it comes out of engagement with the counter locking means.

19. An ignition cable connector according to claim 17, wherein said clip comprises an inclined part (413) adapted to cooperate with an inclined surface (410) of said ignition cable connector.

* * * * *